United States Patent [19]

Imhof

[11] 4,456,144

[45] Jun. 26, 1984

[54] TANK HAVING A FLOATING ROOF AND SEAL

[75] Inventor: Heinrich Imhof, Offenbach am Main, Fed. Rep. of Germany

[73] Assignee: Ingenieurbüro Imhof GmbH, Offenbach am Main, Fed. Rep. of Germany

[21] Appl. No.: 456,314

[22] Filed: Jan. 6, 1983

[30] Foreign Application Priority Data

Jan. 25, 1982 [DE] Fed. Rep. of Germany ..... 3202278

[51] Int. Cl.[3] ..... B65D 87/20

[52] U.S. Cl. ..... 220/222; 220/224

[58] Field of Search ..... 220/221, 222, 224, 226

[56] References Cited

U.S. PATENT DOCUMENTS

| | | | |
|---|---|---|---|
| 4,099,643 | 7/1978 | Wardwell et al. | 220/222 |
| 4,116,358 | 9/1978 | Kinghorn et al. | 220/222 |
| 4,397,399 | 8/1983 | Wagoner | 220/222 |
| 4,406,377 | 9/1983 | Bruening | 220/221 |

FOREIGN PATENT DOCUMENTS

| | | |
|---|---|---|
| 2358636 | 7/1977 | Fed. Rep. of Germany . |
| 2832978 | 3/1979 | Fed. Rep. of Germany . |
| 1921667 | 4/1979 | Fed. Rep. of Germany . |
| 2320066 | 5/1979 | Fed. Rep. of Germany . |

*Primary Examiner*—George T. Hall

*Attorney, Agent, or Firm*—Toren, McGeady and Stanger

[57] ABSTRACT

In an arrangement for removal of precipitation from the vertical inner wall 1 of a tank having a floating roof, a water stripping element 2 is provided which interrupts the water film 6, running down the inner wall, absorbs the water and removes it at a suitable point. For this purpose, the stripping element 2 consists of a layered unit of elastic materials which are constructed in the vertical direction alternately of water absorbing and water permeable layers 3 and of water impermeable layers 4. The upper and the lower layers consist of water impermeable layers. The unit forms in the cross-section a rhomboid so that the individual layers 3, 4 are pressed at an acute angle towards the tank wall and each individual layer comes with its end face in full contact with the tank wall. The stripping element is combined of individual pieces to a closed ring which is held by the receiving elements and is pressed against the tank wall by spring elements.

4 Claims, 3 Drawing Figures

TANK HAVING A FLOATING ROOF AND SEAL

The invention relates to an arrangement for removal of precipitation from the vertical inner wall of a tank having a floating roof, and comprises an annular stripping element which is pressed resiliently against the tank wall above conventional annular gap seals or weather plates.

To prevent vaporization losses and the accumulation of dangerous vapors, volatile, liquid refinery products are primarily stored in tanks with a floating roof. The annular gap, required for the interference-free vertical movement of the floating roof, between the vertical tank wall and the floating roof must here be closed by means of an elastic sealing element which is able to equalize operational changes in the annular gap width as well as strong non-circularities and indentations of the tank wall and to prevent as much as possible that product vapors escape and precipitation enters. Today, usually annular gap seals at tanks with floating roofs are divided into a primary seal and a secondary seal, wherein the primary seal which faces the stored product is to hold back the greater portion of the product vapors and the secondary seal which is directed towards the atmosphere is to prevent penetration of precipitation in addition to improving the total sealing effect.

While one so far tolerated the penetration of small amounts of precipitation into the stored product because a large number of refinery products and water can by nature be easily separated, in the interim one is interested in a protection against precipitation which is as complete as possible. For a number of stored products which are presently important, penetration of precipitation is damaging to the product. In addition, corrosion in the tank bottom region is increased due to the aqueuos phase. Another disadvantage consists in unavoidable product losses and the cleaning expenditure during separation of the accumulated water.

The so far known secondary seals and weather protection devices are suitable to remove precipitation which falls directly into the annular gap. However, the water film which runs down the inner wall of the tank during a downpour could not be effectively removed with these means.

It is generally known to use so-called weather plates to remove the precipitation which falls directly into the annular gap between the tank wall and the floating roof. Here at the outer, upper edge of the floating roof a plurality of narrow, scale-like overlapping plates are attached with an inclination towards the tank wall, wherein the free ends of the weather plates slightly touch the tank wall. The precipitation falling against the weather plates is removed towards the floating roof (German Pat. No. 23 20 066, and German Pat. No. 19 21 667). However, the use of weather plates must today be considered as technically outdated. Weather plates only have a minimum effect during the aimed-for limitation of vapor emission. The precipitation which enters during a downpour against the inner wall of the tank cannot be removed with weather plates, particularly since the ends of the weather plates, directed towards the tank wall, are usually rounded off so that the weather plates do not get stuck or damage the lining of the inner wall of the tank during the upward movement of the floating roof at the inner tank wall.

Also, designs are known which are based on the above mentioned weather plates (U.S. Pat. No. 4,116,358) or narrow spring webs (German Pat. No. 23 58 636) as support and which, with the aid of a sealing blanket, continuously closing the entire annular gap width above or below the weather plates or spring webs, and a continuous profile seal, attached at the ends of the weather plates or spring webs, represent a genuine secondary sealing with good emission reduction and removal of the precipitation which enters into the annular gap. But the water film which results during a downpour at the tank wall can also not be effectively removed with these designs.

Also, designs are known in which a thick walled rubber blanket with incorporated leaf springs spans the annular gap as a continuous sleeve under elastic bending (German Pat. No. 28 32 978). It has proven to be disadvantageous that this sleeve may turn over during the upward movement of the floating roof and in this state has no stripping action for the precipitation which runs down the tank wall.

It has been found that the water stripping action of the secondary seals which act by contact pressure and by adapting to the shape is limited due to fine unevenness and a coating of rust at the tank wall as well as the cohesion and capillary effect of the water film.

The invention is therefore based on the task to develop a water stripping element which is able to interrupt the water film which runs down a vertical tank wall, to absorb the water and to remove it at a suitable point. This element is to be installed above the known secondary seals or weather plates. In the ideal case, the water stripping element should be sufficiently elastic and vapor-tight on the products side so that, in addition to the guaranteed removal of the water film, it can also fulfill the function of a sealing element to limit vapor emissions.

The defined task is solved according to the invention in that an annular stripping element, pressed resiliently against the tank wall above the conventional annular gap seals or weather plates, comprises a layered unit of electric materials which is constructed in the vertical direction alternately of water absorbing and water permeable layers and of water impermeable layers, wherein the upper and lower cover layer consist of water impermeable layers and the entire unit forms in the cross-section a rhomboid, so that when pressed against the tank wall, the individual layers are directed towards the tank wall at an acute angle and each individual layer comes in full contact with the tank wall with its end face, and that in addition the stripper unit, combined of individual pieces to a closed ring, is held in short receiving sections and is pressed against the tank wall by a plurality of individually acting spring elements wherein the perpendicular webs of the receiving sections are perforated so that the absorbed water can flow out.

The water permeable layers consist of materials with a felt-like, fleece-like or fibrous structure or another structure which is absorbent and water permeable. Needle felt or needle fleece of corrosion-, weather-, and decay-resistant plastics are, for instance, suitable for this purpose.

The water impermeable layers are made advantageously by applying a rubber coating or an elastic plastic substance between the water permeable layers. Thus, the entire unit achieves the required strength and elasticity.

The cover side and the underside of the unit are also constructed of water impermeable layers, wherein the underside receives a particularly thick rubber coating or other coating so that the entire melt is vapor-tight from the bottom.

The stripper unit which is combined to a closed ring of individual pieces is advantageously held in short receiving sections and is pressed against the tank wall by a plurality of individually acting spring elements. The receiving sections are perforated at their perpendicular webs so that the absorbed water can flow off.

The water film which runs down the inner wall of the tank is first divided by the stripper unit. A part of the water is removed directly from the wall via the upper cover layer of the unit. The remaining amount of water penetrates into the water permeable layers of the unit, is conducted forcibly away from the tank wall by the water impermeable layers and emerges at the perforation of the receiving section. The weather plates, or the sealing blanket of the secondary seal, arranged below the stripper unit, removes the water towards the floating roof.

The number of layers and the total thickness of the stripper unit are dimensioned in such a way that even during extreme amounts of precipitation the bottom water permeable layer only still has to remove small amounts of water. By arranging the water impermeable layers between the water permeable layers, it is achieved that the respective water permeable layer which is located below cannot be moistened from the top and thus keeps its complete water absorbing action.

The described stripper unit according to the invention for annular gap seals at tanks with floating roof offers the following advantages:

- effective removal of the water film from the inner wall of the tank and thus preventing that water enters the tank,
- reduction of product emission,
- protection of the inner lining of the tank from damage by weather plates,
- protection against wear of the weather plates due to friction at the tank wall.

Further details are elucidated below with the aid of exemplified embodiments shown in the drawing.

Figure 1:
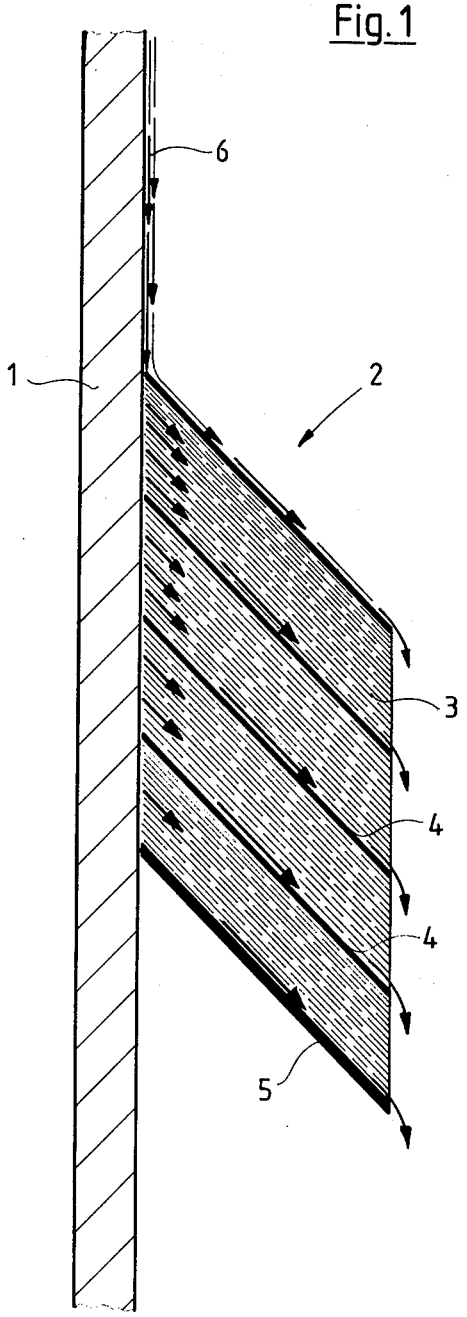
FIG. 1 shows the mode of operation of the invention.

In FIG. 1, the mode of operation of the stripper unit according to the invention is shown. The stripper unit, identified in general with the reference number 2, is pressed by means of a not shown pressure device against the tank wall 1. Due to the rhomboidal cross-sectional shape, the individual layers of the unit are directed towards the tank wall under an acute angle. The water permeable layers 3 consist of plastic needle felt, the water impermeable layers 4 are made by applying a rubber-elastic plastic substance. The water film 6 which runs down the tank wall 1 is divided when it reaches the stripper unit 2. A part of the water is already deflected from the tank wall by the upper cover layer of the unit. The remainder of the water film reaches into the gap between the tank wall and the stripper unit. By interrupting the water film and offering a large, wettable surface, the water permeable layers 3 absorb the remaining water film in steps from the tank wall. The water impermeable layers 4 prevent the mutual moistening of the water-absorbing layers, so that the layer, always located below, maintains its full absorptive effect and on the other hand, the water, absorbed in the individual layers, is forcibly removed to the rear of the stripper unit. The bottom cover layer 5 of the stripper unit is of particularly thick construction and acts simultaneously as sealing element to limit product emission.

Figure 2:
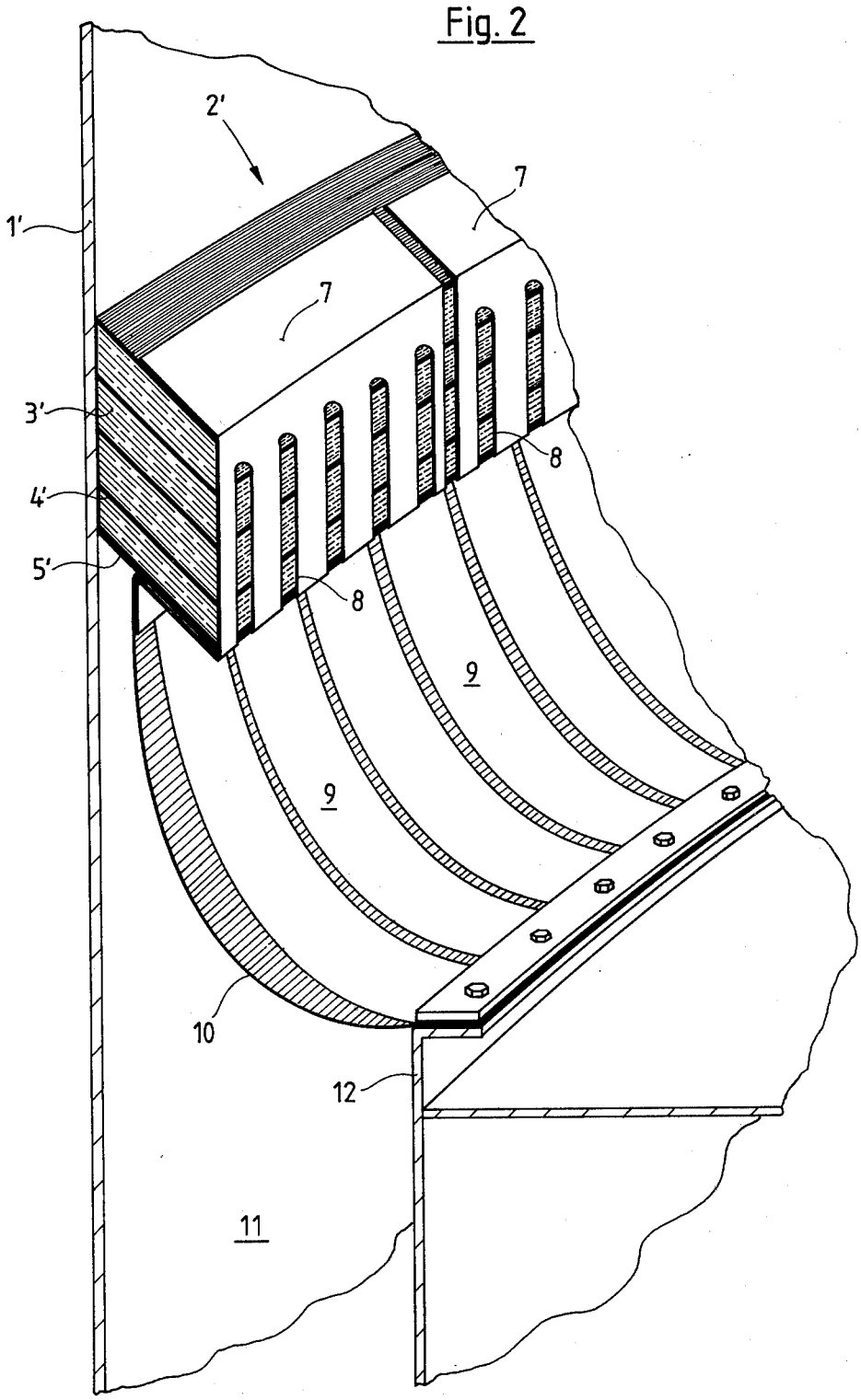
FIG. 2 shows a perspective sectional view of a secondary seal at a tank with a floating roof.

FIG. 2 shows a perspective sectional view of a secondary seal at a tank with a floating roof, with the stripper unit according to the invention as the outer contact element to the tank wall which simultaneously fulfills the function of a profile seal. Comparable structural parts are identified with the reference numbers used for FIG. 1, however are provided with a prime.

The stripper unit 2′ sits in a force-locking manner in short, C-shaped receiving sections 7 which are pressed toward the tank wall by narrow spring bands 9. The secondary sealing blanket 10 is continuously and firmly connected with the lower cover layer 5 of the stripper unit 2′. The secondary sealing blanket spans the entire annular gap 11 and is attached together with the spring bands 9 at the outer, upper edge of the floating roof 12. The C-shaped receiving sections 7 have perforations 8 at their perpendicular webs so that the water, absorbed from the tank wall, can emerge here and be removed above the secondary sealing blanket 10 towards the floating roof.

Figure 3:
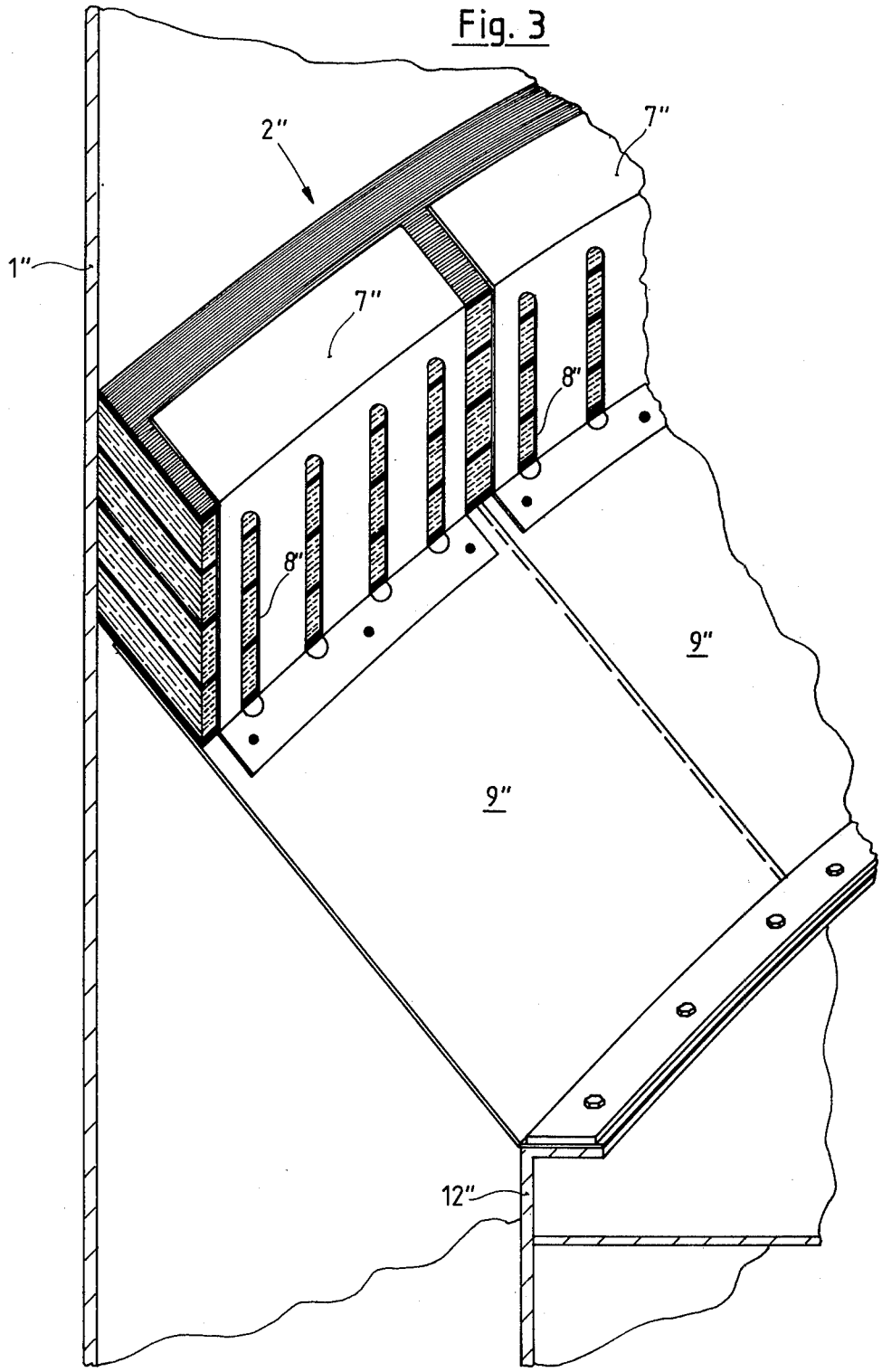
FIG. 3 shows the stripper unit with inventional weather plates.

In FIG. 3, the stripper unit according to the invention is shown in connection with conventional weather plates. The stripper unit 2″, is attached at the upper end of the weather plates 9″ by means of Z-shaped receiving sections 7″ and is directed toward the tank wall 1″ at an acute angle. The water which emerges at the perforation 8″ of the Z-shaped receiving section 7″ is removed by means of the weather plates 9″ to the floating roof 12″.

I claim:

1. An arrangement for removal of precipitation from the vertical inner wall of a tank having a floating roof, comprising an annular stripping element which is pressed resiliently against the tank wall above conventional annular gap seals or weather plates, characterized in that said stripping element consists of a layered unit of elastic materials which is constructed in the vertical direction alternately of water absorbing and water permeable layers and of water impermeable layers, wherein the upper and the lower cover consist of water impermeable layers and the entire unit forms in the cross-section a rhomboid so that, when pressed to said tank wall, said individual layers are directed toward said tank wall at an acute angle and each individual layer comes with its end face in full contact with said tank wall, and that, in addition, said stripper unit, combined to a closed ring of individual pieces, is held in short receiving sections and pressed against said tank wall by a plurality of individually acting spring elements, wherein the perpendicular webs of said receiving sections are perforated so that the absorbed water can flow off here.

2. A stripping element according to claim 1, characterized in that said water permeable layers are of corrosion-, weather- and decay-resistant plastics with a felt-like, fleece-like or fibrous structure or another absorbent and water permeable structure.

3. A stripping element according to claims 1 and 2, characterized in that said water impermeable layers are made by applying a rubber coating or an elastic plastic substance between said water permeable layers.

4. A stripping element according to one of the claims 1 to 3, characterized in that the bottom cover layer of said stripper unit has a particularly thick rubber coating or elastic plastic coating so that said stripping element is vapor-tight from the bottom.

* * * * *